US007942355B2

(12) United States Patent
Yamazaki et al.

(10) Patent No.: US 7,942,355 B2
(45) Date of Patent: May 17, 2011

(54) SELF-PROPELLED CRUSHER AND MANAGEMENT SYSTEM FOR SELF-PROPELLED CRUSHER

(75) Inventors: Kazuyuki Yamazaki, Hirakata (JP); Yukinori Maeda, Ichinomiya (JP); Ryoichi Togashi, Hirakata (JP); Yasutaka Nishida, Hirakata (JP); Hiroshi Yoshida, Ibaraki (JP)

(73) Assignee: Komatsu Ltd., Tokyo (JP)

( * ) Notice: Subject to any disclaimer, the term of this patent is extended or adjusted under 35 U.S.C. 154(b) by 210 days.

(21) Appl. No.: 12/227,110

(22) PCT Filed: May 9, 2007

(86) PCT No.: PCT/JP2007/059598
§ 371 (c)(1),
(2), (4) Date: Dec. 4, 2008

(87) PCT Pub. No.: WO2007/129730
PCT Pub. Date: Nov. 15, 2007

(65) Prior Publication Data

US 2009/0114750 A1 May 7, 2009

(30) Foreign Application Priority Data

May 10, 2006 (JP) ..... 2006-131886

(51) Int. Cl.
*B02C 25/00* (2006.01)

(52) U.S. Cl. ..... 241/101.2; 241/101.3; 241/101.74; 241/268

(58) Field of Classification Search ..... 241/101.74, 241/101.741, 101.3, 30, 101.2, 268
See application file for complete search history.

(56) References Cited

U.S. PATENT DOCUMENTS

| | | | |
|---|---|---|---|
| 6,332,582 | B1 | 12/2001 | Ikegami et al. |
| 6,354,524 | B1 | 3/2002 | Nakayama et al. |
| 2003/0034412 | A1 | 2/2003 | Togashi et al. |
| 2004/0124295 | A1 | 7/2004 | Sugimura et al. |

(Continued)

FOREIGN PATENT DOCUMENTS

| | | | |
|---|---|---|---|
| JP | 06-023287 | A | 2/1994 |

(Continued)

OTHER PUBLICATIONS

International Preliminary Report on Patentability and Written Opinion of the International Searching Authority, dated Nov. 11, 2008, issued in connection with International Application Serial No. PCT/JP2007/059598 (5 pages).

(Continued)

*Primary Examiner* — Mark Rosenbaum
(74) *Attorney, Agent, or Firm* — Holtz, Holtz, Goodman & Chick, PC

(57) ABSTRACT

A self-traveling crushing machine includes: a traveling device; a crushing device that is provided on the traveling device and crushes a to-be-crushed object supplied; an overload escaping section that escapes an overload of the crushing device; and a controller that controls the crushing device. In the self-traveling crushing machine, the crushing device is a jaw crusher in which the to-be-crushed object is supplied to a V-shaped space formed by a fixed jaw and a movable jaw and the movable jaw swings relative to the fixed jaw to crush the to-be-crushed object, and the controller includes: an escape-operation determining section that determines whether or not the overload escaping section has operated; and an information output section that sends the escape operation information to an outside when the escape-operation determining section determines that the escape operation has been conducted.

6 Claims, 18 Drawing Sheets

U.S. PATENT DOCUMENTS

2004/0200914 A1 10/2004 Hishiyama et al.

FOREIGN PATENT DOCUMENTS

| | | | |
|---|---|---|---|
| JP | 2570057 | B2 | 10/1996 |
| JP | 11-010023 | A | 1/1999 |
| JP | 2000-024539 | A | 1/2000 |
| JP | 2001-070810 | A | 3/2001 |
| JP | 2003-053203 | A | 2/2003 |
| JP | 2003-159546 | A | 6/2003 |
| JP | 2004-174452 | A | 6/2004 |
| JP | 2004-278216 | A | 10/2004 |
| JP | 2004-322075 | A | 11/2004 |

OTHER PUBLICATIONS

International Search Report dated Jul. 31, 2007, issued in a counterpart International Application.

FIG.6

951

| STROKE L | OUTLET GAP S | OVERLOAD |
|---|---|---|
| L 1 | S 1 | ○ |
| L 2 | S 2 | △ |
| L 3 | S 3 | × |

FIG.10

137T

ESCAPE-OPERATION INFORMATION DB

| IDENTIFICATION INFORMATION | LATITUDE | LONGITUDE | RECEIVED DATE | RECEIVED TIME |
|---|---|---|---|---|
| A0001 | N34.00.00 | E135.00.00 | 05/12/01 | 11:00 |
| A0015 | N35.00.00 | E139.00.00 | 05/12/02 | 15:00 |
| A0001 | N34.00.00 | E139.00.00 | 05/12/05 | 14:00 |
| ... | ... | ... | ... | ... |

SELF-PROPELLED CRUSHER AND MANAGEMENT SYSTEM FOR SELF-PROPELLED CRUSHER

This application is a U.S. National Phase Application under 35 USC 371 of International Application PCT/JP2007/059598 filed May 9, 2007.

TECHNICAL FIELD

The present invention relates to a self-traveling crushing machine and an administrative system for a self-traveling crushing machine.

BACKGROUND ART

In recent years, to recycle waste materials generated at construction sites, civil engineering sites and the like, self-traveling crushing machines are installed at construction sites and the like to crush the waste materials generated during work operations so that the waste materials are recycled as materials for work operations.

An example of a self-traveling crushing machine includes a traveling device and a jaw crusher installed thereon. The jaw crusher produces aggregate having a predetermined particle-diameter from a to-be-crushed object by compression force and shear force while supplying the to-be-crushed object such as a concrete mass to a V-shaped space formed by a fixed jaw and a movable jaw and swinging the movable jaw relative to the fixed jaw.

Because such a jaw crusher employs compression force and shear force to crush the to-be-crushed object, the device body of the jaw crusher including the fixed jaw and the movable jaw may be overloaded depending on operating conditions of an operator and characteristics of the to-be-crushed object.

In view of the above, the conventional jaw crusher includes: a toggle plate that interconnects the swinging movable jaw and the device body having the fixed jaw; and an overload escaping section in which the toggle plate buckles to let go the load on the movable jaw when the movable jaw is overloaded to a predetermined extent (e.g., see, Patent Document 1).

Another overload escaping section includes, instead of the toggle plate, a hydraulic cylinder with a close fit mechanism in which strokes are changed by hydraulic pressure when the movable jaw is overloaded (e.g., see, Patent Document 2).

Patent Document 1: JP-A-06-23287 (FIGS. 1 and 4)

Patent Document 2: JP-A-2003-53203 (FIG. 1)

DISCLOSURE OF THE INVENTION

Problems to Be Solved by the Invention

However, according to the above-mentioned overload escaping section disclosed in Patent Documents 1 and 2, because the buckling of the toggle plate and the change in the strokes of a hydraulic cylinder with a close fit mechanism occur within the crushing device, the buckling and the stroke change cannot be visually recognized from the outside by an operator. Accordingly, depending on the occurrence frequency, it is possible that the crushing device suffers a serious damage. Such being the case, time needed for restoration greatly lowers productivity.

An object of the invention is to provide: a self-traveling crushing machine in which, when a crushing device such as a jaw crusher performs an overload escaping operation, the operation is notified to the outside so that a third person including an operator can recognize occurrence frequency of the overload escaping operation, so that the damage of the crushing device can be prevented and the time needed for restoration can be reduced; and an administrative system of the self-traveling crushing machine.

Means for Solving the Problems

A self-traveling machine according to an aspect of the invention includes: a traveling device; a crushing device that is provided on the traveling device and crushes a to-be-crushed object supplied; an overload escaping section that escapes an overload of the crushing device; and a controller that controls the crushing device, in which the crushing device is a jaw crusher in which the to-be-crushed object is supplied to a V-shaped space formed by a fixed jaw and a movable jaw and the movable jaw swings relative to the fixed jaw to crush the to-be-crushed object, and the controller comprises: an escape-operation determining section that determines whether or not the overload escaping section has operated; and an information output section that sends the escape operation information to an outside when the escape-operation determining section determines that the escape operation has been conducted.

Here, the escape-operation detecting section can retrieve operation of the overload escaping section as an electric signal by a detector such as a sensor and perform an operation determination based on the value indicated by the electric signal.

Any wired or wireless suitable method may be employed to output the escape operation information from the information output section to the outside. For example, public network such as mobile phone lines may be utilized for outputting to the outside. For another example, the escape operation information may be wirelessly outputted together with a machine number and a present location information of the self-traveling crushing machine to a specialized communication satellite.

With the aspect of the invention, because the escape-operation determining section and the information outputting section provided to the self-traveling crushing machine send the escape operation information to the outside when the overload escaping section operates, even when the inside of the crushing machine cannot be visually recognized, a third person such as an operator can recognize the escape operation. Accordingly, damage of the crushing machine that is generated depending on the occurrence frequency of the escape operation can be prevented, and time required for restoration can be reduced.

In addition, because the technique is applied to a jaw crusher and other crushing machines likely to be overloaded, advantages such as the prevention of damage of the crushing machine and the reduction of restoring work time can be favorably enjoyed.

In the above arrangement, it is preferable that the overload escaping section is a hydraulic cylinder with a close fit mechanism having a first end connected to a crushing device body on which the fixed jaw is fixed and a second end connected to the movable jaw, the hydraulic cylinder with the close fit mechanism having a stroke that changes when the movable jaw is overloaded, and the escape-operation determining section conducts determination of escape operation based on a detection signal from a stroke sensor that detects change of the stroke of the hydraulic cylinder with the close fit mechanism.

In the above arrangement, it is preferable that the overload escaping section is a hydraulic cylinder with a close fit mechanism having a first end connected to a crushing device body on which the fixed jaw is fixed and a second end connected to the movable jaw, the hydraulic cylinder with the close fit mechanism having a stroke that changes when the movable jaw is overloaded, the hydraulic cylinder with the close fit mechanism is connected to a crushing device body via a link member, and the escape-operation determining section conducts determination of escape operation based on a detection signal from an angle sensor that detects an angle change of the link member caused by a change of the stroke of the hydraulic cylinder with the close fit mechanism.

With this arrangement, because the escape-operation determining section determines the escape operation by the change of stroke of the cylinder or the change of angle of the link, load generated in the hydraulic cylinder with the close fit mechanism upon escape operation can be reduced to prevent damage of the overload escaping section.

In the above arrangement, it is preferable that the overload escaping section is a toggle plate, the toggle plate having a first end connected to a crushing device body on which the fixed jaw is fixed, the toggle plate having a second end connected to the movable jaw, the toggle plate buckling when the movable jaw is overloaded, the escape-operation determining section conducts determination of escape operation based on a detection signal from a stress sensor that detects a change of a stress generated in the toggle plate.

In the above arrangement, it is preferable that the escape-operation determining section determines presence of the escape operation when the stress sensor detects a detection stress greater than a threshold stress that is set in advance to be smaller than a rupture stress of the toggle plate.

In the above arrangement, it is preferable that the overload escaping section is a toggle plate, the toggle plate having a first end connected to a crushing device body on which the fixed jaw is fixed, the toggle plate having a second end connected to the movable jaw, the toggle plate buckling when the movable jaw is overloaded, the toggle plate is connected to a reaction-force supporting mechanism, the reaction-force supporting mechanism being provided to the crushing device and supporting a force applied to the movable jaw, and the escape-operation determining section conducts determination of escape operation based on a detection signal from a stress sensor that detects a change of a stress applied to the reaction-force supporting mechanism.

With this arrangement, because the escape-operation determining section determines presence of the escape operation by the change of stress of the toggle plate, the buckling of the toggle plate is prevented in advance by determining the presence of the escape operation before the toggle plate buckles, thereby greatly reducing time required for restoring work including exchange of the toggle plate.

An administrative system of a self-traveling crushing machine according to another aspect of the invention includes: at least one self-traveling crushing machine that comprises a traveling device, a crushing device that is provided on the traveling device and crushes a to-be-crushed object supplied, an overload escaping section that escapes an overload of the crushing device, and a controller that controls the crushing machine; and a server communicatively coupled to the self-traveling crushing machine, in which the crushing device is a jaw crusher in which the to-be-crushed object is supplied to a V-shaped space formed by a fixed jaw and a movable jaw and the movable jaw swings relative to the fixed jaw to crush the to-be-crushed object, and the controller comprises: an escape-operation determining section that determines whether or not the overload escaping section has operated; and an information output section that sends the escape operation information to an outside when the escape-operation determining section determines that the escape operation has been conducted, and the server comprises: an information receiving section that receives the escape operation information sent from the information output section; and an escape-operation information accumulating section that accumulates the escape operation information received by the information receiving section in association with the self-traveling crushing machine from which the escape operation information is sent.

With this arrangement, because the escape-operation information of the overload escaping section of the self-traveling crushing machine is accumulated in the escape-operation information accumulating section of the server, the server can perceive escape operation occurrence frequency or the like for each self-traveling crushing machine. Accordingly, administration of the self-traveling crushing machine is facilitated, and the maintenance work provided by a service center can be timely conducted.

In the above arrangement, it is preferable that the server comprises: an escape-operation count determining section that determines whether or not a count of the escape operation information accumulated in the escape-operation information accumulating section is no less than a predetermined threshold; and a notifier that notifies that the count is no less than the threshold when the escape-operation count determining section determines that the count is no less than the threshold.

With this arrangement, because the escape-operation count determining section and the notifier are provided, an administration that corresponds to a crushing load of the self-traveling crushing machine installed at a construction site is possible.

In the above arrangement, it is preferable that the notifier includes an alarm-information sending section that sends alarm information to a notification target selected from the at least one self-traveling crushing machine, and the controller of the self-traveling crushing machine includes an alarm calling section that calls an alarm when the alarm information is received.

Here, calling an alarm by the alarm calling section is performed by calling an alarm in the form of image data on a monitor screen provided to the self-traveling crushing machine or by employing sounds of a buzzer or the like.

With this arrangement, because the alarm-information sending section provided to the notifier and the alarm calling section provided to the self-traveling crushing machine allow teaching, via audio and image information, an operator of a self-traveling crushing machine that has been decided to be overloaded by the server, that the self-traveling crushing machine is overloaded. Accordingly, the load reduction of the self-traveling crushing machine can be further favorably achieved.

BRIEF DESCRIPTION OF DRAWINGS

FIG. 6 is a schematic diagram showing a table structure in which a relationship between strokes of the hydraulic cylinder with the close fit mechanism and an outlet gap of the crusher in the embodiment.

FIG. 10 is a schematic view showing a structure of an escape-operation information database of the embodiment.

BEST MODE FOR CARRYING OUT THE INVENTION

Embodiments of the invention will be described below with reference to the drawings.

First Embodiment

1. Overall Arrangement

Figure 1:
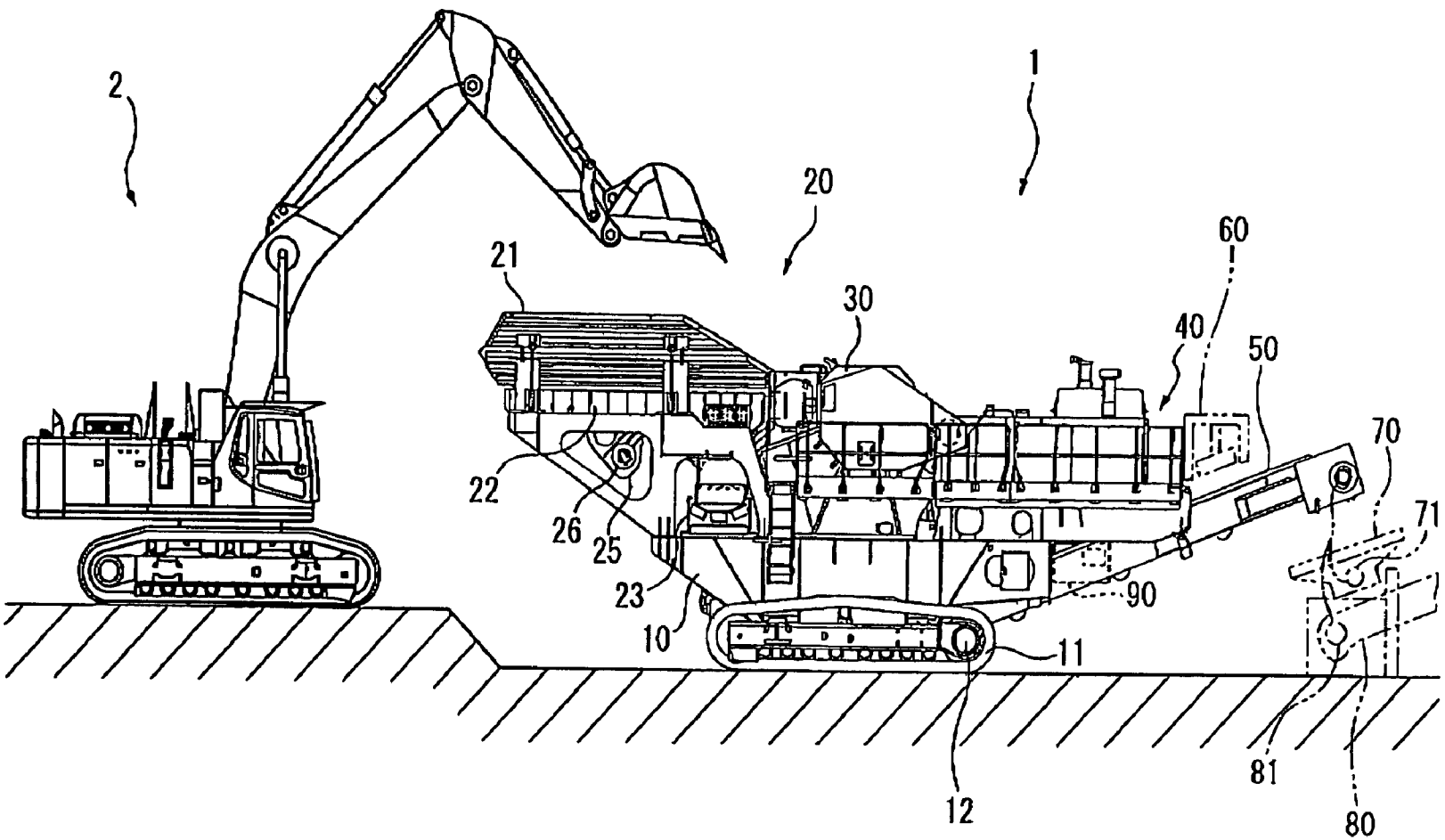
FIG. 1 is a lateral view of a self-traveling crushing machine according to a first embodiment of the invention.

FIG. 1 shows a self-traveling crushing machine 1 according to a first embodiment of the invention. The self-traveling crushing machine 1 crushes raw materials thrown in by a loader 2 such as a hydraulic shovel to produce products having a predetermined particle-diameter.

The self-traveling crushing machine 1 includes: a body 10 having a pair of lower traveling bodies 11; a supplier 20 installed on the body 10 at a rear portion thereof with respect to a front-rear direction (i.e., the left-right direction in FIG. 1); a crusher 30 installed in front of the supplier 20; a power line 40 installed in front of the crusher 30; and a discharge conveyor 50 obliquely extending forward and upward from a lower portion of the body 10.

The lower traveling body 11 of the body 10 is of crawler type and is driven by a hydraulic motor 12. The lower traveling body 11 may also be of wheel type similarly driven by a hydraulic motor or may employ both the crawler type arrangement and the wheel type arrangement. By driving the lower traveling body 11, the self-traveling crushing machine 1 can be moved to an optimal position.

The supplier 20 includes a hopper 21, a grizzly feeder 22, and a side conveyor 23. The hopper 21 is shaped in a reverse truncated cone formed wider at a higher portion thereof. Raw materials are thrown into an open upper face of the hopper 21. The grizzly feeder 22 vibrates and delivers the raw materials thrown in through the hopper 21 to the crusher 30. The side conveyor 23 discharges uncrushed raw materials falling from a gap of the grizzly feeder 22 to a lateral side of the self-traveling crushing machine 1. The grizzly feeder 22 is driven by a hydraulic motor 26 of a vibrator 25. The side conveyor 23 is driven by a hydraulic motor 27 (not shown in FIG. 1; see, FIG. 2) described below.

The crusher 30, which will be described in detail below, is a jaw crusher having a fixed jaw and a movable jaw. A swing jaw 30A of the crusher 30 is driven by a hydraulic motor 31 (FIG. 2).

Figure 2:
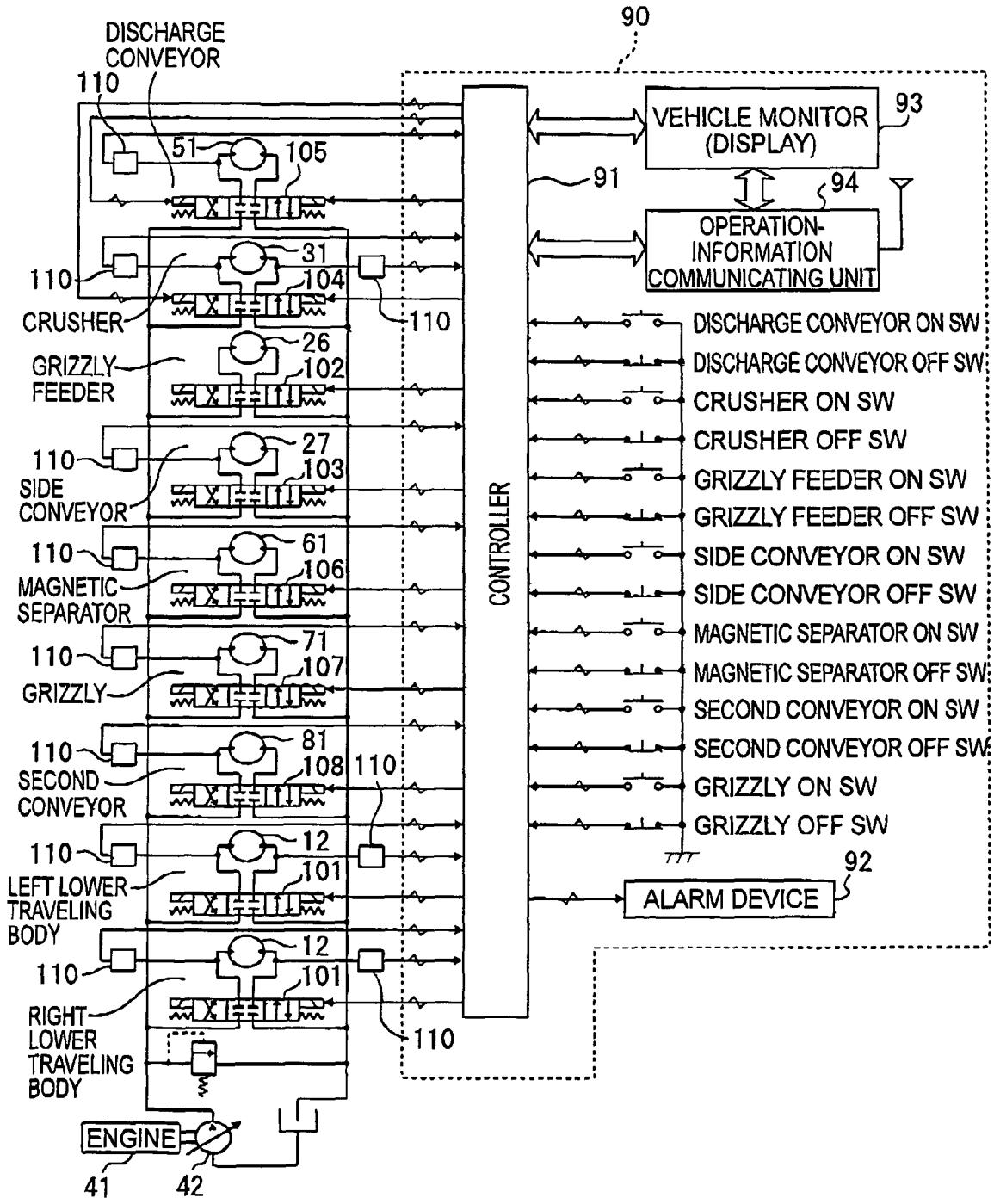
FIG. 2 is a block diagram showing a hydraulic circuit and a control structure of the embodiment.

As shown in FIG. 2, the power line 40 includes an engine 41 and a hydraulic pump 42 driven by the engine 41.

Hydraulic pressure is supplied from the hydraulic pump 42 via control valves 101 to 108 to the hydraulic motor 12 of the lower traveling body 11, the hydraulic motor 26 of the vibrator 25 provided to the grizzly feeder 22, the hydraulic motor 31 of the crusher 30, a hydraulic motor 51 of the discharge conveyor 50 that will be described below, a hydraulic motor 61 of a magnetic separator 60 that will be described below, a hydraulic motor 71 of a grizzly 70, and a hydraulic motor 81 of a second conveyer 80.

As shown in FIG. 1, the discharge conveyor 50 conveys crushed objects crushed by the crusher 30 to a front side of the vehicle to discharge the crushed objects onto the ground where the crushed objects are accumulated. As set forth above, the discharge conveyor 50 is driven by the foremost hydraulic motor 51 (see, FIG. 2).

When raw materials thrown in include a concrete mass containing rebar or the like, the magnetic separator 60 may be post-attached as shown by two-dot chain line in FIG. 1 to remove the rebar from the discharge conveyor 50. In addition, instead of directly accumulating on the ground the crushed objects discharged from the discharge conveyor 50, the crushed objects may be sifted by the grizzly 70 to separate larger crushed objects from smaller crushed objects according to the particle diameter.

In this case, the crushed objects having smaller particle diameter which have fallen from the gap of the grizzly 70 are conveyed to a distant site by the second conveyor 80. The crushed objects having larger particle diameter which have remained on the grizzly 70 are slid off the grizzly 70 to be accumulated on the ground or conveyed to another site by a third conveyor (not shown).

2. Detailed Arrangement of Crusher 30

Figure 3:
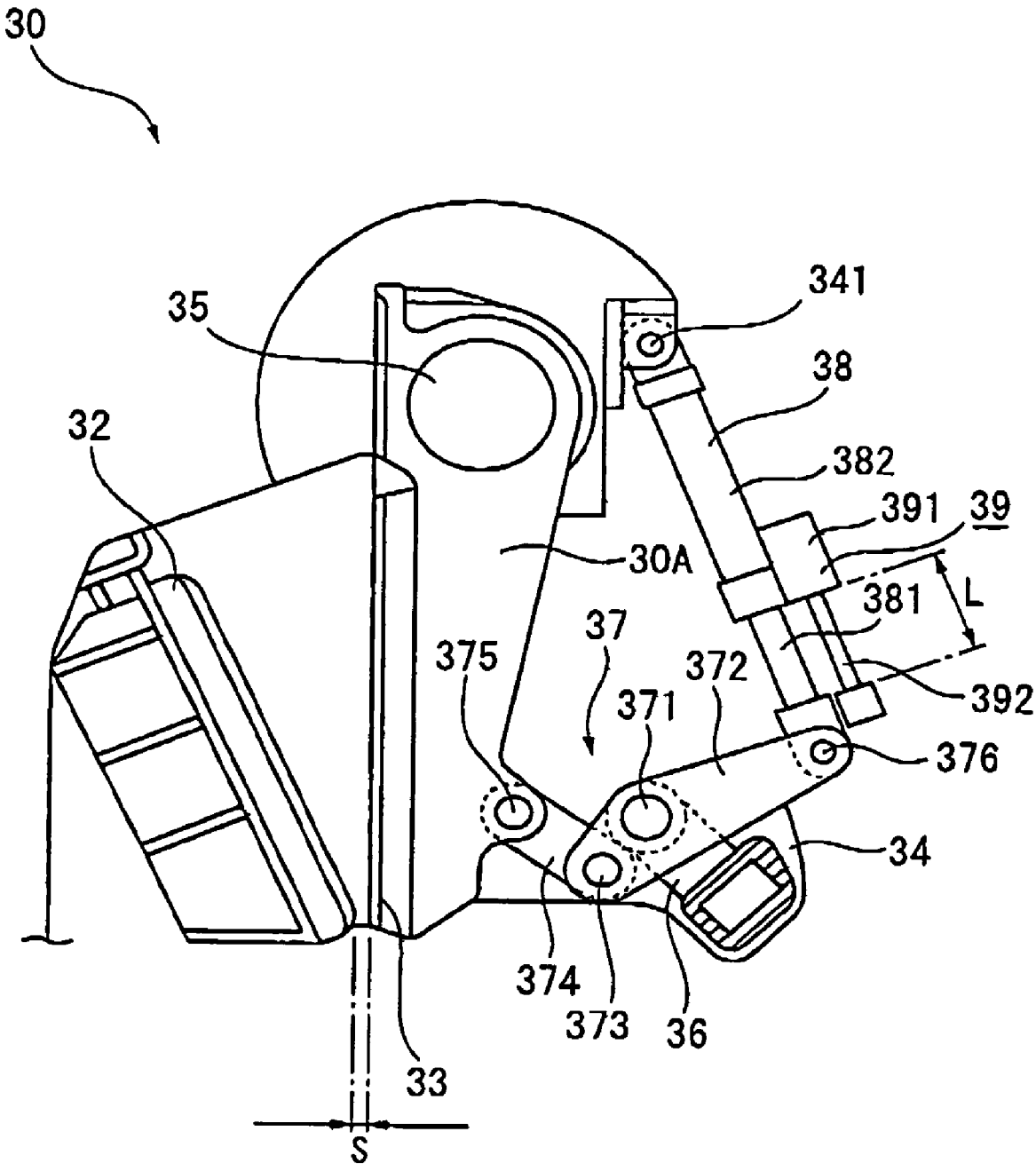
FIG. 3 is a lateral view showing a structure of a crusher of the embodiment.

As shown in FIG. 3, the crusher 30 is a jaw crusher having a fixed jaw 32 and a movable jaw 33. The fixed jaw 32 is attached on a pair of frames 34 opposing each other in a direction perpendicular to the paper plane of FIG. 3. The movable jaw 33 is disposed opposite to the fixed jaw 32 and swingably hung on an eccentric drive shaft 35 provided between the frames 34. A V-shaped space between the fixed jaw 32 and the movable jaw 33 forms a crush chamber.

Though not shown in FIG. 3, a pulley is provided on an end of the eccentric drive shaft 35, an end of a V-belt is wound around the pulley, and the eccentric drive shaft 35 rotates by a hydraulic motor provided to another end of the V-belt.

By rotation of the eccentric drive shaft 35, the movable jaw 33 swings toward and away from the fixed jaw 32. When to-be-crushed objects are supplied to the V-shaped crush chamber from the grizzly feeder 22, the movable jaw 33 swings, so that the to-be-crushed objects are sandwiched and crushed between the fixed jaw 32 and the movable jaw 33.

When the to-be-crushed object is crushed to a predetermined grain size or less, crushed grains are discharged to the discharge conveyor 50 through an outlet gap S between lower ends of the fixed jaw 32 and the movable jaw 33.

At a back side of the movable jaw 33, a bracket 36 is provided on a member interconnecting the pair of frames 34. A link mechanism is provided between the bracket 36 and the movable jaw 33 to form a movable-jaw load receiver 37.

Whereas the crusher 30 of the embodiment is equipped with the movable-jaw load receiver 37 of so-called up-thrust type in which the movable jaw 33 swings downward as if ripping off the crush face of the fixed jaw 32, the crusher 30 may be of down-thrust type in which the movable jaw 33 is pushed upward.

The movable-jaw load receiver 37 includes a lever 372 whose intermediate portion is swingably attached to the bracket 36 by a pin 371 and a link member 374 rotatably provided to a first end of the lever 372 by a pin 373. An end of the link member 374 is rotatably connected to a lower back of the movable jaw 33 by a pin 375.

A second end of the lever 372 is rotatably connected to a distal end of a piston rod 381 of a hydraulic cylinder 38 with a close fit mechanism.

The reaction force generated when the to-be-crushed objects are crushed in the crush chamber is sent to the hydraulic cylinder 38 with the close fit mechanism via the link member 374 and the lever 372.

The hydraulic cylinder 38 with the close fit mechanism, which is a lock cylinder, forms the overload escaping section and is disposed in a manner that a cylindrical axis thereof is substantially vertical. A bottom of the hydraulic cylinder 38 with the close fit mechanism is rotatably attached to an upper portion of the frame 34 by a pin 341.

Figure 4:
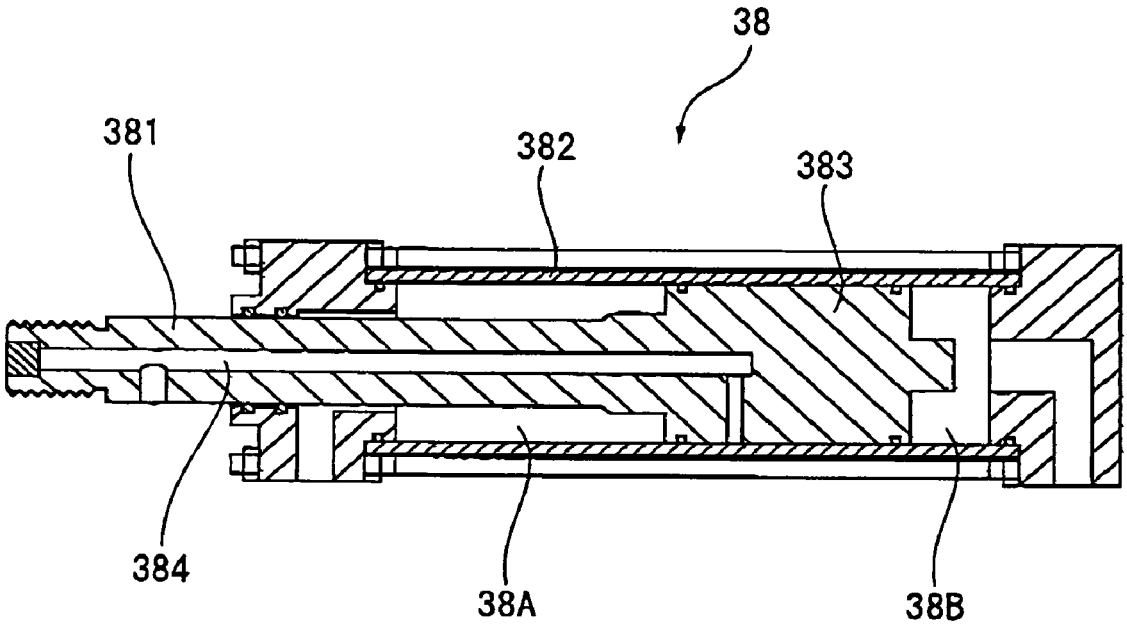
FIG. 4 is a cross-sectional view showing a structure of a hydraulic cylinder with a close fit mechanism of the embodiment.

As shown in FIG. 4, the hydraulic cylinder 38 with the close fit mechanism includes a cylinder 382 and a piston 383 whose distal end is provided with the piston rod 381. The piston 383 is forced into the cylinder 382 to divide an interior space of the cylinder 382 into a cylinder head chamber 38A and a cylinder bottom chamber 383.

An oil hole 384 is formed in the piston rod 381 along an axial direction of the piston rod 381. The oil hole 384 extends to the piston 383 and communicates with the inside of the cylinder 382 at an outer circumference of the piston 383.

In the hydraulic cylinder 38 with the close fit mechanism, the piston 383 is normally fixed at a specified position in the cylinder 382 by closing fit of the cylinder 382.

When hydraulic fluid is supplied to the oil hole 384, the hydraulic fluid is supplied between the outer circumference of the piston 383 and the inner circumference of the cylinder 382, whereby a force that expands the cylinder 382 radially outward is applied to the cylinder 382.

At this time, if the hydraulic fluid is supplied to the cylinder head chamber 38A or the cylinder bottom chamber 38B, the hydraulic fluid permits the piston 383 to move in the expanded cylinder 382.

In the hydraulic cylinder 38 with the close fit mechanism set forth above, the escape operation is conducted as follows. When the movable jaw 33 is overloaded, the piston 383 fixed by closing fit of the cylinder 382 is forced to slide by the load, so that a position of the piston 383 is changed to remove the load applied on the movable jaw 33.

Subsequently, if the hydraulic fluid is supplied to the oil hole 384, the piston 383 is permitted to move within the cylinder 382, thereby allowing restoration of the original state.

When the hydraulic cylinder 38 with the close fit mechanism set forth above is employed as the overload escaping section, the position of the piston 383 can be easily restored by supplying hydraulic fluid within the cylinder 382 upon restoration after the escape from the overload, thereby facilitating restoration.

In addition, as shown in FIG. 3, the hydraulic cylinder 38 with the close fit mechanism is provided with a stroke sensor 39. The stroke sensor 39 includes a detector body 391 and a measuring element 392.

The detector body 391 is fixed to an outer surface of the cylinder 382 of the hydraulic cylinder 38 with the close fit mechanism. A distal end of the measuring element 392 is fixed to a distal end of the piston rod 381 of the hydraulic cylinder 38 with the close fit mechanism.

When the piston rod 381 of the hydraulic cylinder 38 with the close fit mechanism retreats toward the cylinder 382 for escaping overload, the measuring element 392 of the stroke sensor 39 correspondingly retreats toward the detector body 391. The detector body 391 converts an amount of the retreat into electric signals and outputs the electric signals to a controller 91. Incidentally, the stroke sensor 39 may exemplarily be a linear potentiometer.

3. Control Structure of Hydraulic Circuit

3-1 Overall Arrangement of Control Unit 90

The self-traveling crushing machine 1 set forth above is controlled by a control unit 90 shown in FIG. 2.

The control unit 90 includes ON-OFF switches (SW) for the above-mentioned working equipments, namely, the grizzly feeder 22, the side conveyor 23, the crusher 30, the discharge conveyor 50, the magnetic separator 60, the grizzly 70, and the second conveyor 80. Signals from the switches are outputted to the controller 91. Note that a switch for the left and right lower traveling bodies 11 are omitted in FIG. 2.

The signals from the switches are inputted to the controller 91 and the controller 91 outputs control signals to the control valves 101 to 108 for the working equipments 11, 22, 23, 30, 50, 60, 70, and 80 to switch driving statuses of the working equipments.

Next, a detector 110 such as a pressure sensor is provided adjacent to an entrance to each of the hydraulic motors 12, 27, 31, 51, 61, 71, and 81 except the hydraulic motor 26 of the grizzly feeder 22. A pressure value in the hydraulic circuit is outputted as a pressure signal from the detector 110 to the controller 91.

Here, the hydraulic motor 31 of the crusher 30 and the hydraulic motor 12 of the left and right lower traveling bodies 11 are each provided with the detectors 110 on the hydraulic circuit adjacent to the entrance and adjacent to the exit so that a pressure value can be detected both during an orthodox drive and during a reverse drive of the hydraulic motors 12 and 31.

The controller 91, formed as a computer including a processor and a storage, determines whether or not an abnormality is present in the working equipments 11, 22, 23, 30, 50, 60, 70, and 80 based on the pressure signals from the detectors 110. If the controller 91 determines that an abnormality is present, the controller 91 outputs a signal to an alarm device 92 such as a buzzer, provided to the control unit 90, to notify an operating personnel that an abnormality is present, and the controller 91 also outputs signals to the control valves 102 to 108 to suitably stop the working equipments 22, 23, 30, 50, 60, 70, and 80.

The controller 91 specifies a portion at which an abnormality is present and displays the same on an ancillary vehicle monitor 93. Also, the controller 91 outputs signals indicating an identification number representing a portion where the abnormality occurred and indicating that an abnormality is present to an operation-information communicating unit 94.

The operation-information communicating unit 94, which forms the information output section, wirelessly outputs operation information, which results from the operation determination by the controller 91, to the outside based on an instruction from the controller 91. Incidentally, GPS (not shown in FIG. 2) is installed on the self-traveling crushing machine 1. Upon output of the operation information, latitude and longitude that provide a present location of the self-traveling crushing machine 1 are wirelessly outputted collaterally.

3-2 Control Structure of Crusher 30 by Control Unit 90

Next, a control structure of the crusher 30 by the above control unit 90 will be described in detail.

Figure 5:
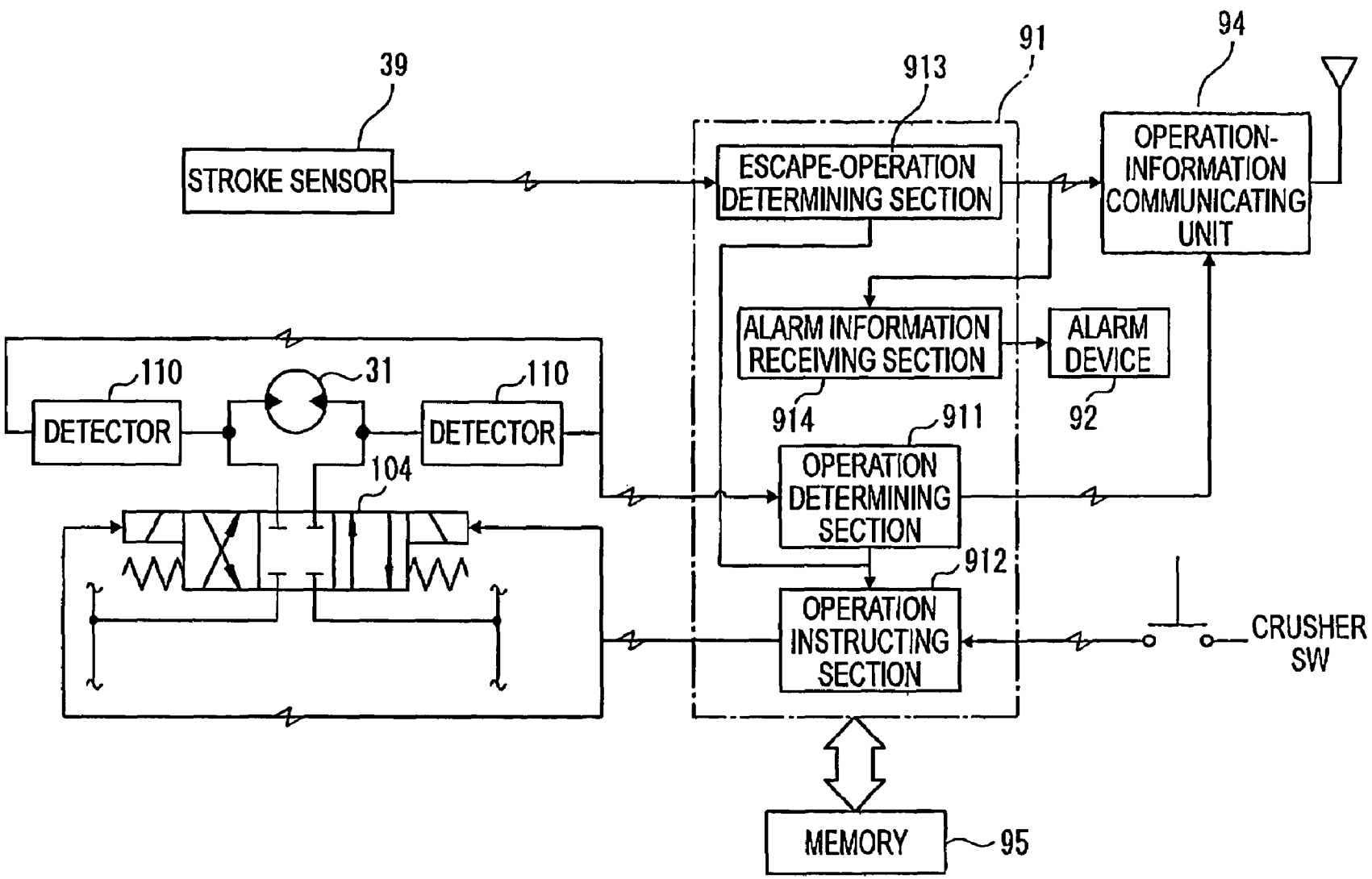
FIG. 5 is a block diagram showing another control structure of the embodiment.

As shown in FIG. 5, the controller 91 includes an operation determining section 911, an operation instructing section 912, an escape-operation determining section 913, and an alarm-information receiving section 914, which are executed as programs.

The operation determining section 911 determines an operation state of the hydraulic motor 31 based on electric signals from the detectors 110 such as pressure sensors provided adjacent to an entrance and adjacent to an exit of the hydraulic motor 31 of the crusher 30. When the operation determining section 911 determines an abnormality is present, the operation determining section 911 outputs signals to such effect to the operation instructing section 912 and sends the signals also to the operation-information communicating unit 94.

The operation instructing section 912 generates and outputs a control instruction for the control valve 104 based on the yield of the operation determining section 911. Specifically, the operation instructing section 912 changes a position by activating a solenoid of the control valve 104 by the control instruction and changes the supplying status of the hydraulic fluid to the hydraulic motor 31 to avoid an operational abnormality.

The escape-operation determining section 913 determines whether or not the crusher 30 is overloaded based on a detection signal outputted from the stroke sensor 39 shown in FIG. 3. When the escape-operation determining section 913 determines that an overload is present, the escape-operation determining section 913 determines that an escape operation by the hydraulic cylinder 38 with the close fit mechanism is conducted. The escape-operation determining section 913 determines the above based on information recorded in a memory 95 provided to the controller 91.

Specifically, a table 951 in which a stroke L of the stroke sensor 39 and a size of the outlet gap S between the lower ends of the fixed jaw 32 and the movable jaw 33 shown in FIG. 3 are associated in the memory 95 as shown in FIG. 6. Statuses of loads applied to the movable jaw 33 that correspond to statuses of the outlet gap S are stored therein. The stored statuses of loads include a normal status (○), an over-threshold status (Δ), and an overload status (x).

Figure 7:
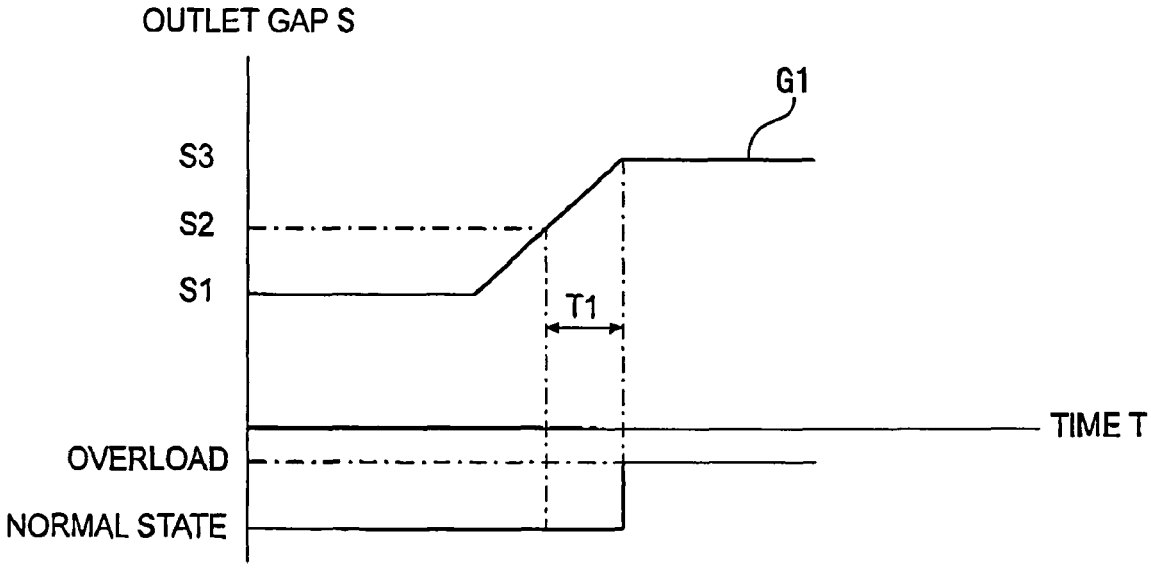
FIG. 7 is a graph for explaining a method for determining overload in the embodiment.

With reference to the table 951 in the memory 95, the escape-operation determining section 913 determines whether or not the overload status is present in correspondence with the size of the outlet gap S as shown in FIG. 7.

Specifically, the escape-operation determining section 913 does not determine that an overload is present even if the deviation of the stroke L is detected to be L2 by the stroke sensor 39 and the corresponding outlet gap S is over a threshold S2. Yet, as shown in the graph G1 in FIG. 7, the escape-operation determining section 913 determines that an overload is present only if the overload status continues for a predetermined time T1, so that a detection error due to an external disturbance can be prevented.

When the escape-operation determining section 913 determines that an overload is present and that the hydraulic cylinder 38 with the close fit mechanism has been operated, the escape-operation determining section 913 outputs signals to such effect to the operation instructing section 912. Based on the signal, the operation instructing section 912 moves a position of the control valve 104 to stop drive of the hydraulic motor 31.

The escape-operation determining section 913 outputs the escape operation results to the operation-information communicating unit 94, and the operation-information communicating unit 94 wirelessly outputs the escape-operation information to such effect.

The wireless output of the escape-operation information by the operation-information communicating unit 94 can be set at various timings.

For example, the escape-operation information may be wirelessly outputted at a timing when the hydraulic cylinder 38 with the close fit mechanism conducts the escape operation. Also, for example, escape-operation information may be accumulated in the memory 95 or the like annexed to the controller 91 so that the escape-operation information can be wirelessly outputted when an interval of the escape operation falls to or below a predetermined threshold (i.e., when the operation is more frequent).

The alarm-information receiving section 914 receives alarm information via the operation-information communicating unit 94. When the alarm-information receiving section 914 receives the alarm information, the alarm-information receiving section 914 outputs a control instruction to the alarm device 92 which forms the alarm-calling unit so that the alarm device 92 calls an alarm including images, sounds or the like.

4. Arrangement of Administrative System

4-1 Overall Arrangement of Administrative System

Figure 8:
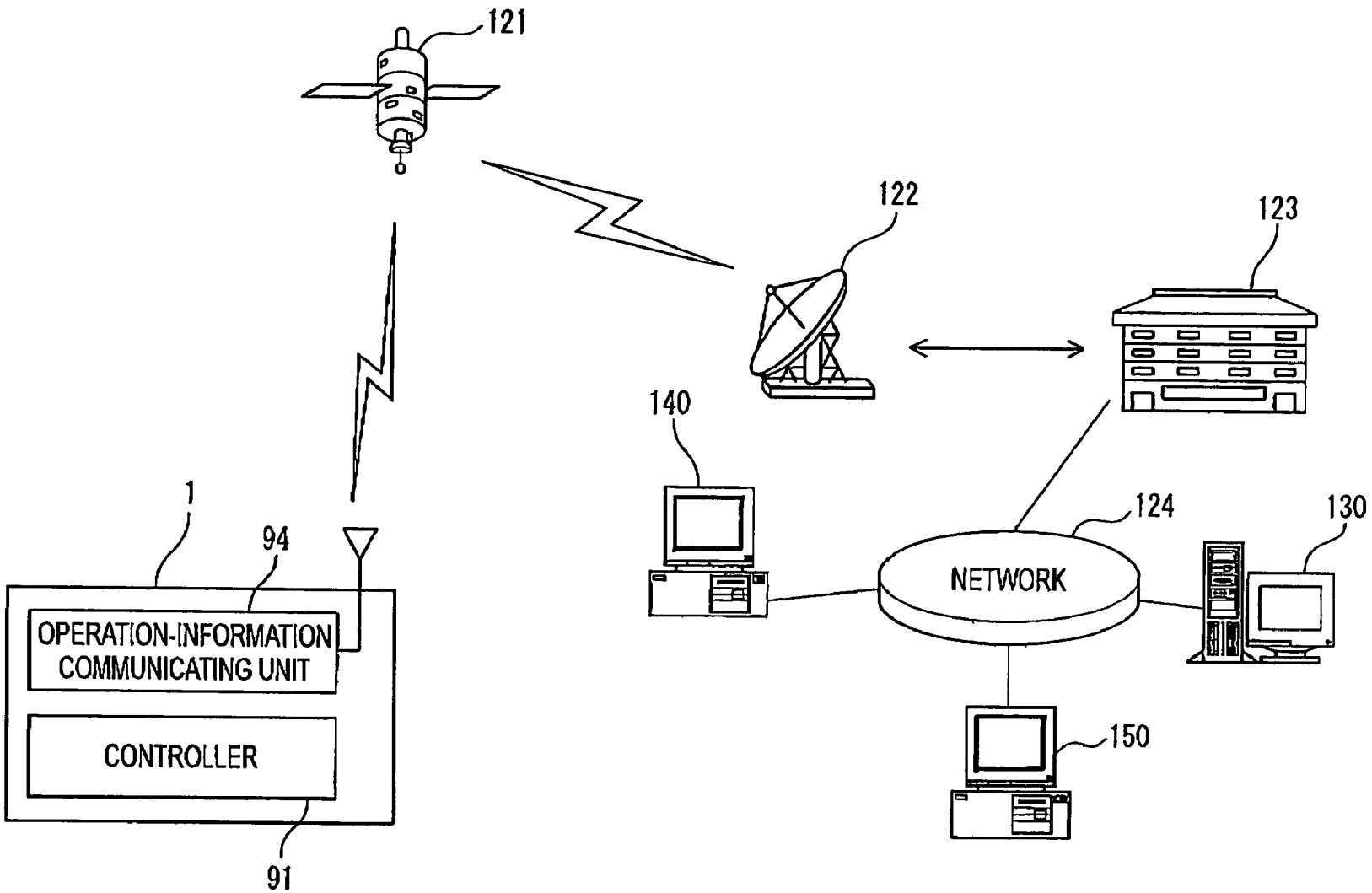
FIG. 8 is a schematic view showing an arrangement of an administrative system of the embodiment.

The escape-operation information wirelessly outputted from the operation-information communicating unit 94 of the self-traveling crushing machine 1 set forth above is concentrated to and processed by an administrative server. Specifically, as shown in FIG. 8, the escape-operation information wirelessly outputted from the operation-information communicating unit 94 is received by a communication satellite 121, forwarded to a satellite-communication earth station 122 and a network-administering station 123 from the communication satellite 121, and concentrated to an administrative server 130 via a network 124.

Incidentally, in the embodiment, the communication satellite 121, the satellite-communication earth station 122, and the network-administering station 123 are intercommunicated via dedicated communication lines, but the network 124 coupling the network-administering station 123 and the administrative server 130 is formed by all-purpose lines such as the Internet.

In addition, an on-site terminal computer 140 placed at an office at a construction site where the self-traveling crushing machine 1 is installed and a service terminal computer 150 placed at a service entity that conducts maintenance and the like of the self-traveling crushing machine 1 are connected to the network 124.

4-2 Arrangement of Administrative Server 130

Figure 9:
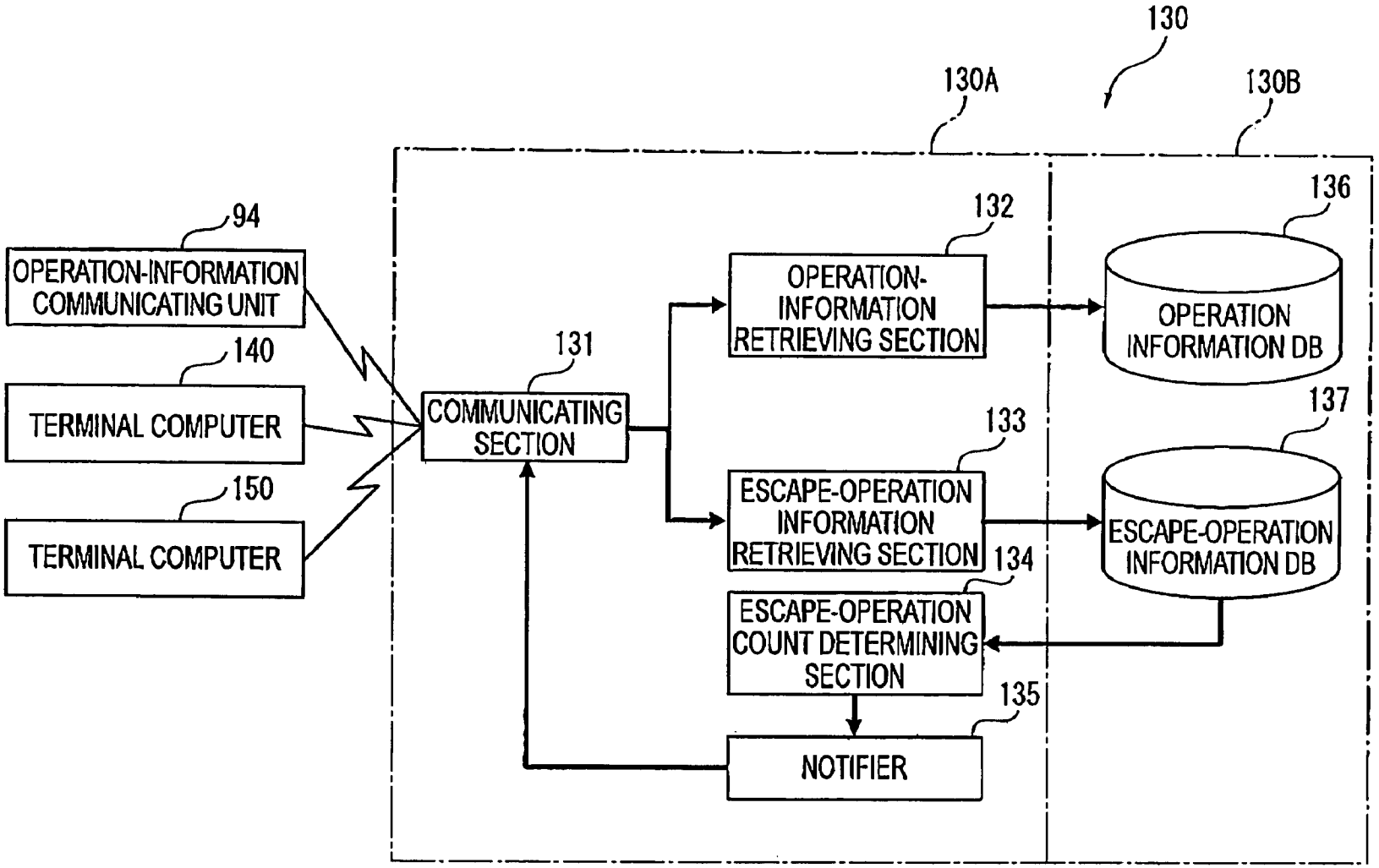
FIG. 9 is a block diagram showing a structure of an administrative server of the embodiment.

As shown in FIG. 9, the administrative server 130 receives, accumulates, and administers operation information and escape-operation information of the self-traveling crushing machine 1 sent from the operation-information communicating unit 94 set forth above, and distributes, as necessary, the information to the operation-information communicating unit 94, the on-site terminal computer 140, and the service terminal computer 150. Specifically, the administrative server 130 is formed as a computer including a processor 130A and a storage 130B.

The administrative server 130 includes programs executed on the processor 130A, i.e., a communicating section 131, an operation-information retrieving section 132, an escape-operation information retrieving section 133, an escape-operation count determining section 134, and a notifier 135. An operation information database 136 and an escape-operation information database 137 are retained in a storage area of the storage 130B.

The communicating section 131 communicates various information including the operation information through communication with the operation-information communicating unit 94 provided to the self-traveling crushing machine 1, the on-site terminal computer 140, and the service terminal computer 150.

The operation-information retrieving section 132 retrieves results of operation determination by the controller 91 based on the information detected by the detectors 110 respectively provided to the portions of the self-traveling crushing machine 1. The retrieved information is accumulated in the operation information database 136 with the identification information such as a machine identification number of the self-traveling crushing machine 1.

The escape-operation information retrieving section 133 retrieves escape-operation information determined by the escape-operation determining section 913 of the controller 91. The retrieved escape-operation information is accumulated in the escape-operation information database 137.

The escape-operation information database 137 accumulates and saves the escape-operation information retrieved by the escape-operation information retrieving section 133 and includes a table structure on which a set of the escape-operation information is recorded as one record.

The escape-operation information database 137 may employ a table-structure database such as a table 137T shown in FIG. 10 in which a record formed by identification information and present location of the self-traveling crushing machine 1 and date and time of receipt are accumulated as the escape-operation information.

The escape-operation count determining section 134 determines in what state the administered self-traveling crushing machine 1 is operated based on the escape-operation information accumulated in the escape-operation information database 137 set forth above. A determination by the escape-operation count determining section 134 can perform determination based on, for example, how many times the escape operation is conducted in a predetermined hours or a predetermined time period. If the escape operation is repeated many times in a period, the escape-operation count determining section 134 determines that the self-traveling crushing machine 1 is driven in an overloaded state.

The notifier 135 makes a notification concerning an operation status in which the self-traveling crushing machine 1 is operated in the overloaded state for the on-site terminal computer 140 and the service terminal computer 150 via the network 124 based on results of determination by the escape-operation count determining section 134. In addition, the notifier 135 sends alarm information telling the overload to the operation-information communicating unit 94 via the communication satellite 121.

The alarm information by the notifier 135 for the operation-information communicating unit 94 by the notifier 135 forms an instruction signal that actuates the alarm device 92 of the self-traveling crushing machine 1. The alarm-information receiving section 914 of the controller 91 that receives the alarm information makes the alarm device 92 to call based on the instruction signal and displays such a message on the vehicle monitor 93.

Here, upon distribution of the information by the notifier 135 to the on-site terminal computer 140 and the service terminal computer 150, it is preferable that not only information telling that the self-traveling crushing machine 1 is operated in an overloaded state but also recommendation information concerning what state is desirable for the self-traveling crushing machine 1 to be operated in and how an overloaded state can be escaped are distributed.

5. Operation of Administrative System

Figure 11:
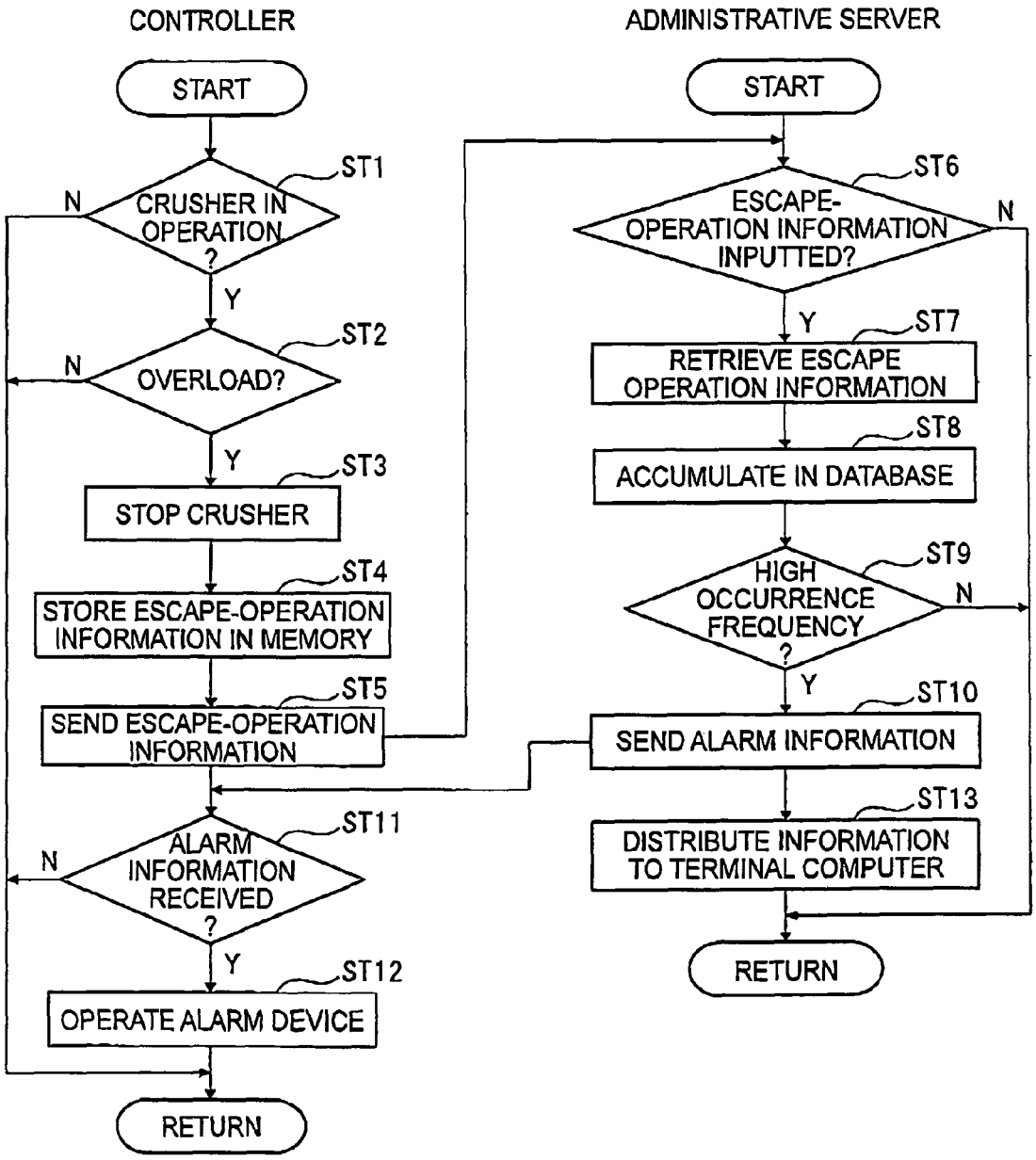
FIG. 11 is a flowchart showing an operation of the administrative system of the embodiment.

Next, an operation of the administrative system of the self-traveling crushing machine 1 set forth above will be described with reference to a flowchart shown in FIG. 11.

(1) While the self-traveling crushing machine 1 is operated, the escape-operation determining section 913 of the controller 91 monitors whether the crusher 30 is in operation or not (Step ST1). If the escape-operation determining section 913 determines that the crusher 30 is in operation, the escape-operation determining section 913 determines that the crusher 30 is overloaded based on detection signals from the stroke sensor 39 (Step ST2).

(2) When the calculated outlet gap S becomes greater than the predetermined threshold S2 in conjunction with the change of stroke L of the stroke sensor 39 and such a state continues longer than the predetermined time T1, the escape-operation determining section 913 determines that the overload is present. Accompanying the determination of the overload, the escape-operation determining section 913 determines that the hydraulic cylinder 38 with the close fit mechanism has been in operation and outputs a signal to the effect to the operating instructing section 912. The operation instructing section 912 stops the crusher 30 based on the signal (Step ST3).

(3) Subsequently the escape-operation determining section 913 stores the date and time at which the escape operation is conducted as escape-operation information in the memory 95 (Step ST 4) and outputs the escape-operation information to the operation-information communicating unit 94. The operation-information communicating unit 94 sends the inputted escape-operation information to the communication satellite 121 with the identification information and the operation information such as the present location information of the self-traveling crushing machine 1 (Step ST5).

(4) The escape-operation information retrieving section 133 of the administrative server 130 determines whether or not the escape-operation information is received in the communicating section 131 (Step ST6). When the escape-operation information is determined to have been inputted, the escape-operation-information retrieving section 133 retrieves the escape-operation information (Step ST7) and accumulates the escape-operation information in the escape-operation information database 137 together with the identification information and the present location information of the self-traveling crushing machine 1 in the operation information that are simultaneously inputted (Step ST8).

(5) While the escape-operation information is being accumulated in the above-described steps, the escape-operation count determining section 134 periodically retrieves the escape-operation information that corresponds to the identification information of the self-traveling crushing machine 1 accumulated in the escape-operation information database 137, and calculates a length of an interval of the escape operation of the crusher 30 to determine whether or not the occurrence frequency of the escape operation is high (Step ST9).

(6) If the occurrence frequency is determined to be high, the escape operation count determining section 134 outputs a signal to such effect to the notifier 135. The notifier 135 generates alarm information and sends the alarm information to the operation-information communicating unit 94 of the corresponding self-traveling crushing machine 1 (Step ST10).

(7) The alarm-information receiving section 914 monitors whether or not the operation information communicating unit 94 receives the alarm information (Step ST11), and when the alarm information is received, the alarm-information receiving section 914 operates the alarm device 92 (Step ST12).

(8) The notifier 135, which outputs the alarm information as set forth above, also distributes the escape-operation information and ancillary recommendation information such as an appropriate operating state of the crusher 30 and the escaping method of the overloaded state to the on-site terminal computer 140 and the service terminal computer 150 via the network 124 (Step ST13).

In the embodiment, as shown in FIG. 3, the stroke sensor 39 detects the change of the stroke L of the piston rod 381 of the hydraulic cylinder 38 with the close fit mechanism for calculating the outlet gap S. Here, movement of the piston 383 of the hydraulic cylinder 38 with the close fit mechanism can be detected in any suitable manner.

Figure 12:
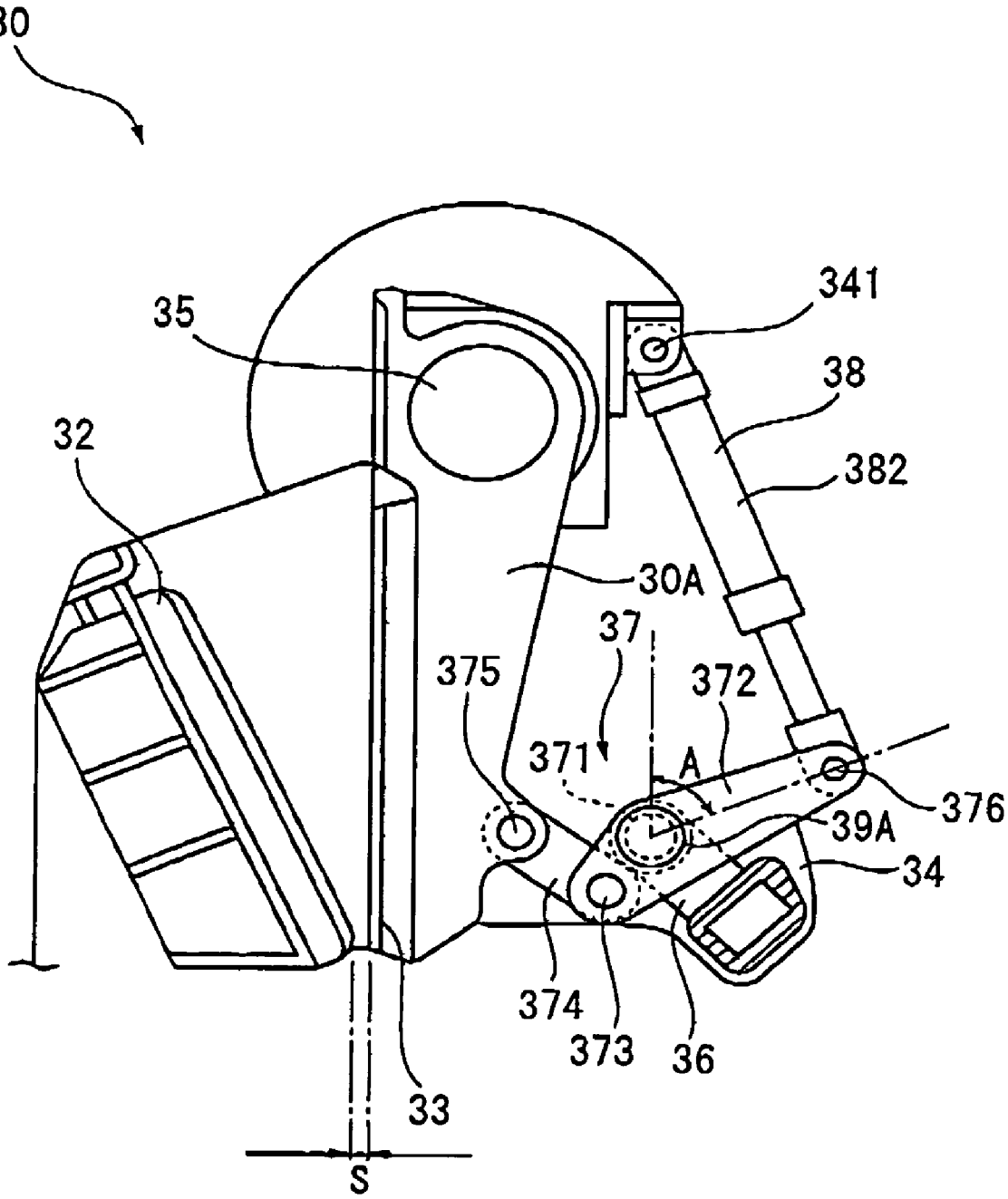
FIG. 12 is a lateral view showing a transformation of the crusher of the embodiment.

For example, as shown in FIG. 12, an angle A of the lever 372 of the movable-jaw load receiver 37 with respect to the vertical direction may be measured by an angle sensor 39A, where relationship between the angle A and the outlet gap S is stored in the memory 95 to calculate the outlet gap S. A rotary potentiometer may be employed as the angle sensor 39A.

In this case, a fixed electrode of the rotary potentiometer is fixed on the pin 371, and a movable electrode is fixed on the lever 372. A standard voltage is applied to the fixed electrode to measure the change of voltage of the movable electrode. Then a rotary position of the movable electrode with respect to the fixed electrode can be detected.

When the piston rod 381 of the hydraulic cylinder 38 with the close fit mechanism retreats toward the cylinder 382 for escaping overload, the lever 372 swings in conjunction with the retreat, thereby allowing measurement of the angle of the lever 372 by the angle sensor 39A.

The control unit 90 stores a table in which the rotary angle A and the size of the outlet gap S formed by the lower ends of the fixed jaw 32 and the movable jaw 33 are associated. Statuses of load applied to the movable jaw 33 can be determined based on the thresholds of the rotary angle A that respectively correspond to the statuses of the outlet gap S. In other words, it is determined whether the load status is a normal status, an over-threshold status, or an overload status.

According to the method for measuring the angle A by the angle sensor 39A as set forth above, because the outlet gap S is converted into the angle A that defines the orientation of the link mechanism, the change of the outlet gap S can be detected in the form of the angle A in an enlarged manner. Accordingly, resolution upon the escape operation detection can be enhanced, thereby improving accuracy of the detection of the escape operation.

Second Embodiment

Next, the second embodiment of the invention will be described. Note that the same components and the like as those in the above description will be provided with the same numerals as in the above and description thereof will be omitted.

In the first embodiment set forth above, the hydraulic cylinder 38 with the close fit mechanism is employed as the overload escaping section, and it is determined whether or not the escape operation by the hydraulic cylinder 38 with the close fit mechanism has been conducted based on the detection signal from the stroke sensor 39.

Figure 13:
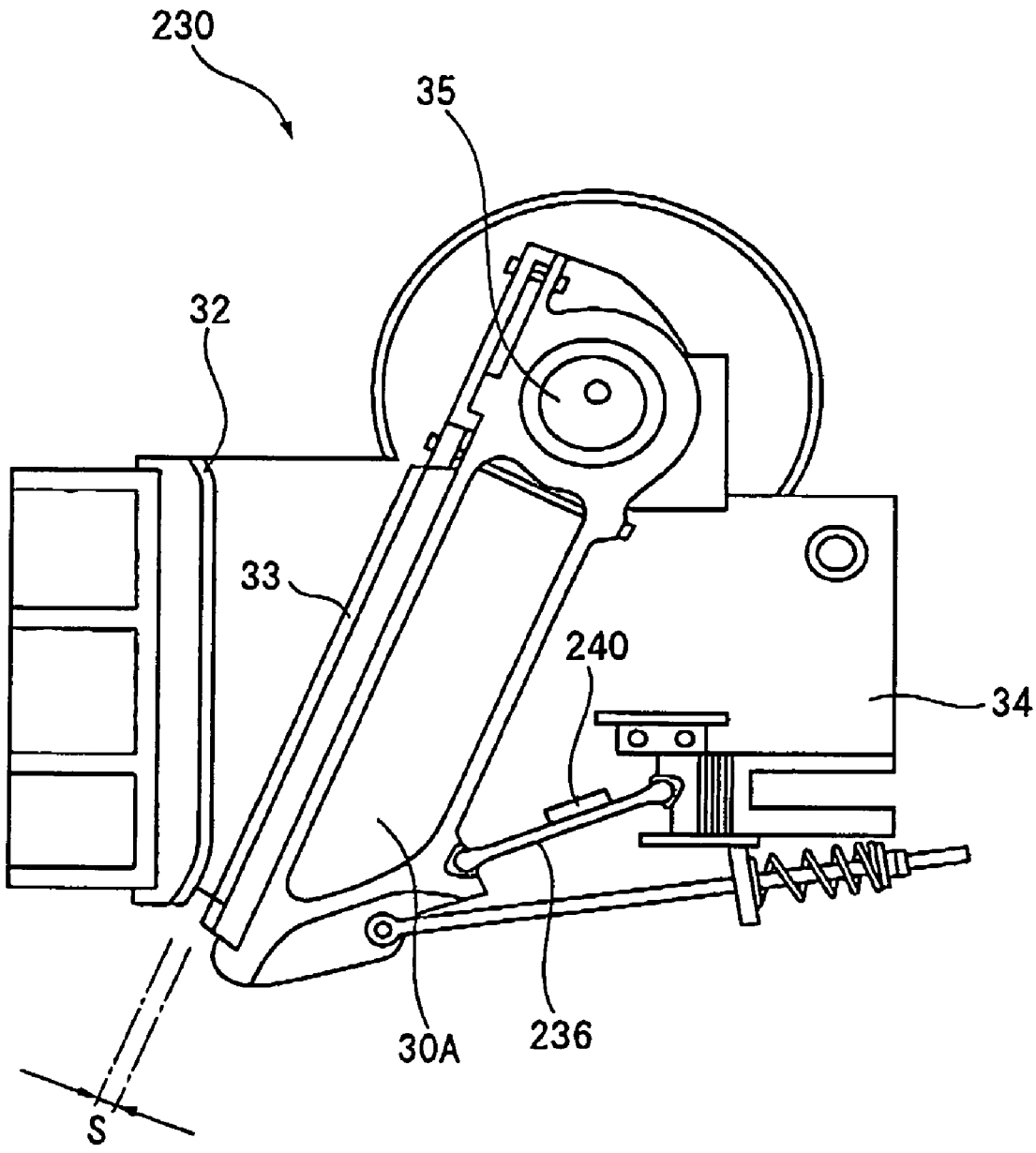
FIG. 13 is a lateral view of a structure of a crusher that forms a self-traveling crushing machine according to a second embodiment of the invention.

In contrast, as shown in FIG. 13, a crusher 230 according to the second embodiment has a back side of the movable jaw 33 and the frame 34 interconnected by a toggle plate 236.

When the movable jaw 33 is overloaded, the toggle plate 236 firstly buckles to conduct the overload-escaping operation.

To determine whether or not the escape operation is conducted, a stress gauge 240 is provided on the toggle plate 236. A detection signal from the stress gauge 240 is processed by the controller to determine whether or not the escape operation is performed.

Here, the following two methods may be employed as a method for determining whether or not the escaping operation of the embodiment is conducted.

1. Case in which Toggle Plate 236 is of Normal Specification

Figure 14:
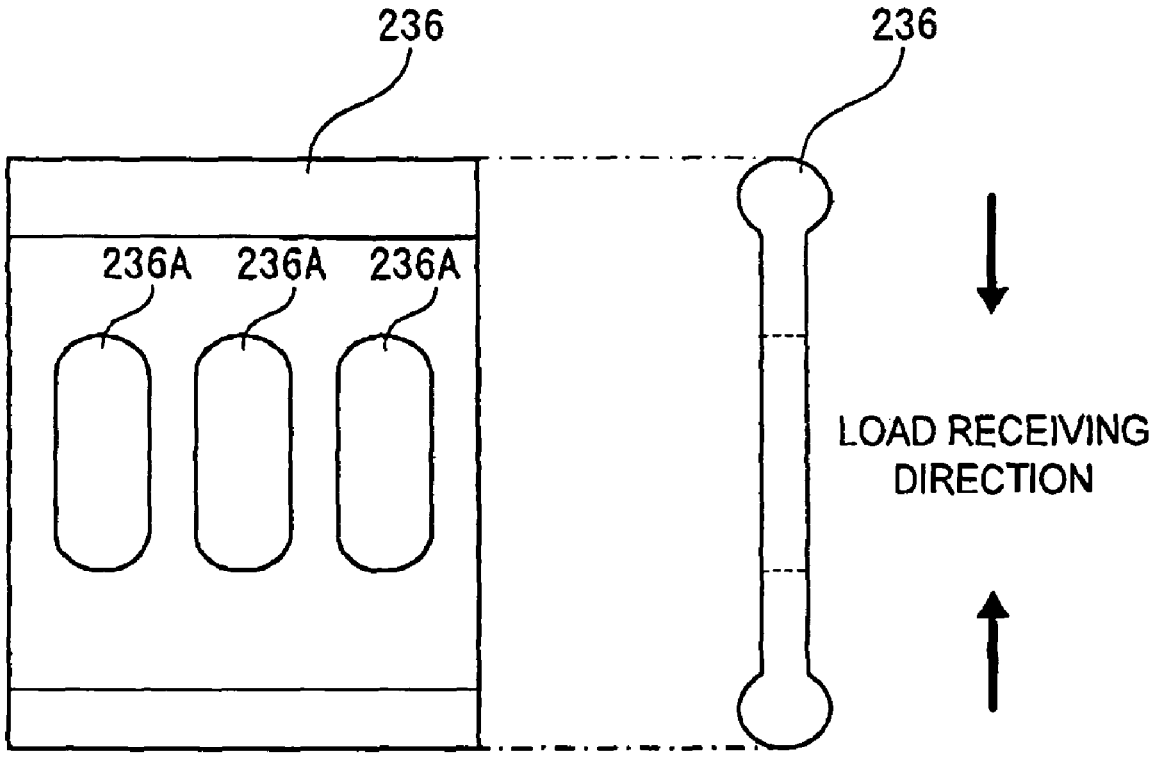
FIG. 14 is a plan view and a lateral view showing a structure of a toggle plate of the embodiment.
Figure 15:
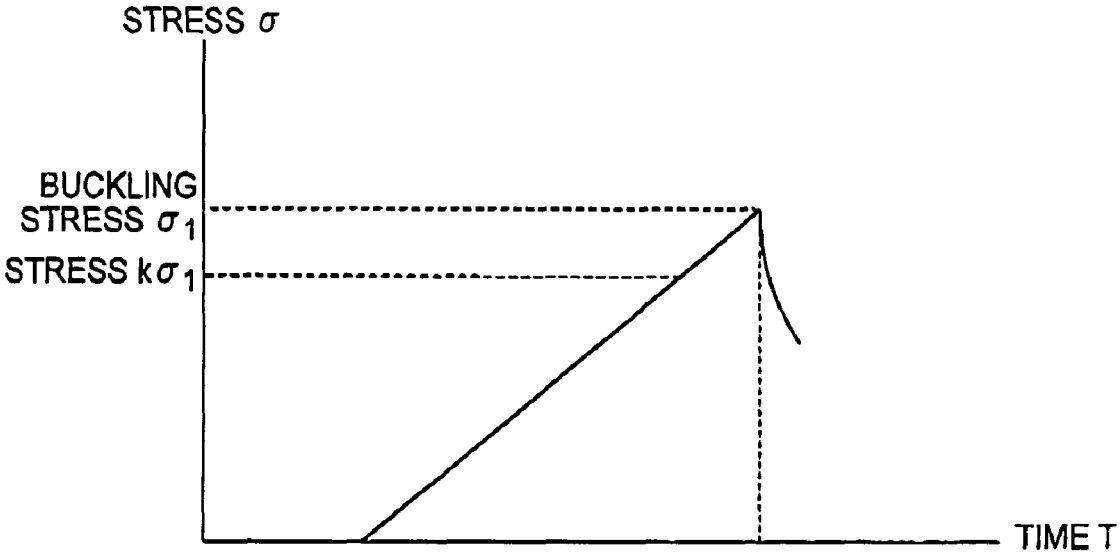
FIG. 15 is a graph showing a relationship between a stress applied on the toggle plate of the embodiment and overload in the embodiment.
Figure 16:
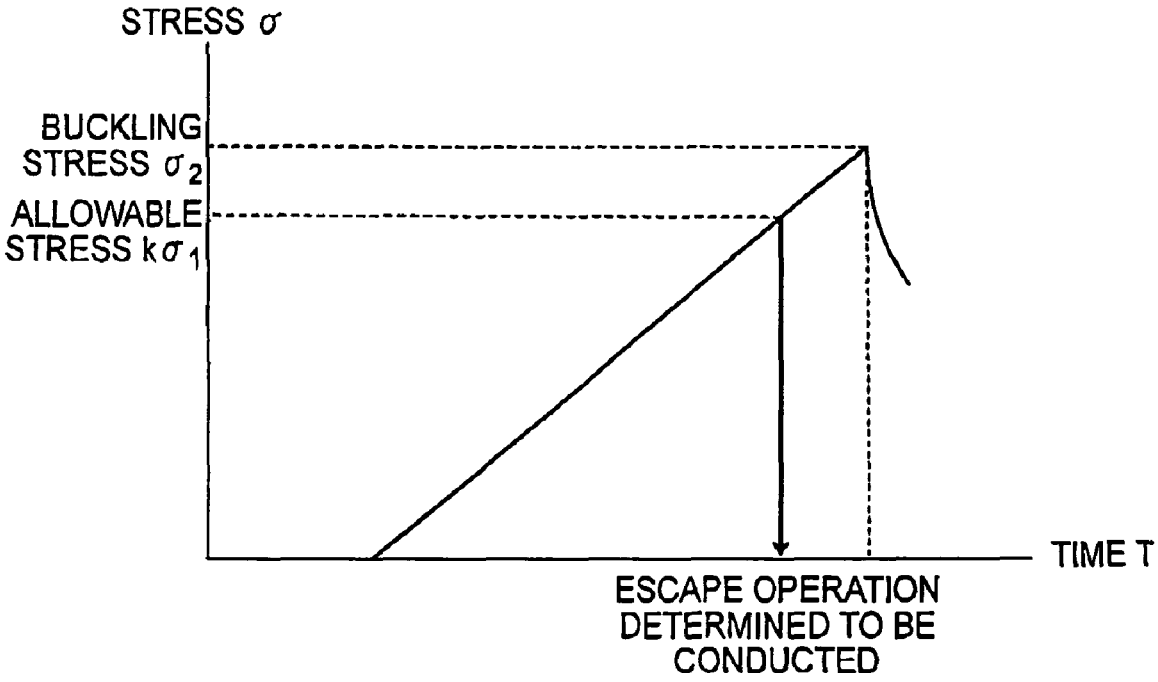
FIG. 16 is another graph showing a relationship between a stress applied on the toggle plate and the overload in the embodiment.

As shown in FIG. 14, one or a plurality of holes 236A are provided substantially at the center of the plate shape. As shown in FIG. 15, the buckling occurring at a stress $\sigma 1$, the escape operation is determined to have been conducted at a stress $k\sigma 1$ which is lower than the stress $\sigma 1$ in view of safety coefficient k ($0<k<1$). Incidentally, if the buckling stress of the toggle plate 236 is set at $k\sigma 1$, the stress $k\sigma 1$ for determining the escape operation may be set at 0.6 to 0.8 $\sigma 1$.

With this arrangement, because escape operation is, without the toggle plate 236 actually having been buckled, determined to have been conducted so that the operation of the crusher 230 is stopped, the crusher 230 can be restored and operated without exchanging the toggle plate 236 for escape operation.

Note that, in this case, the buckling is determined to have occurred at a stress less than the buckling stress $\sigma 1$ of the toggle plate 236, thereby reducing operating quantity.

2. Case in which Toggle Plate 236 is Stronger than Normal Specification

In view of the above, a toggle plate 236 in which a buckling stress $\sigma 2$ of the buckling portion is greater than the normal toggle plate 236 shown in FIG. 14 may be employed. Whether or not escape operation is performed may be determined when the stress detected by the stress gauge 240 reaches, as shown in FIG. 15, a designed allowable stress $\sigma 1$ of the crusher 230 that performs the escape operation.

In this case, whereas a typical toggle plate 236 may include, for example, three holes 236A, the holes 236A may be decreased or omitted.

With this arrangement, because presence of escape operation is not determined until the stress reaches the designed allowable stress $\sigma 1$, the advantage similar to the above can be obtained without the above-mentioned decrease in the operating quantity.

Except for what has been described, the arrangement of the embodiment is the same as that of the first embodiment. No further description is necessary as the determination is performed by the escape-operation determining section in the controller retrieving the signals from the stress gauge 240.

Third Embodiment

Next, a third embodiment of the invention will be described.

In the second embodiment, the stress gauge 240 is provided on the toggle plate 236, and the escape-operation determining section performs the escape operation determination based on signals outputted by the stress gauge 240 that detects the stress applied to the toggle plate 236.

Figure 17:
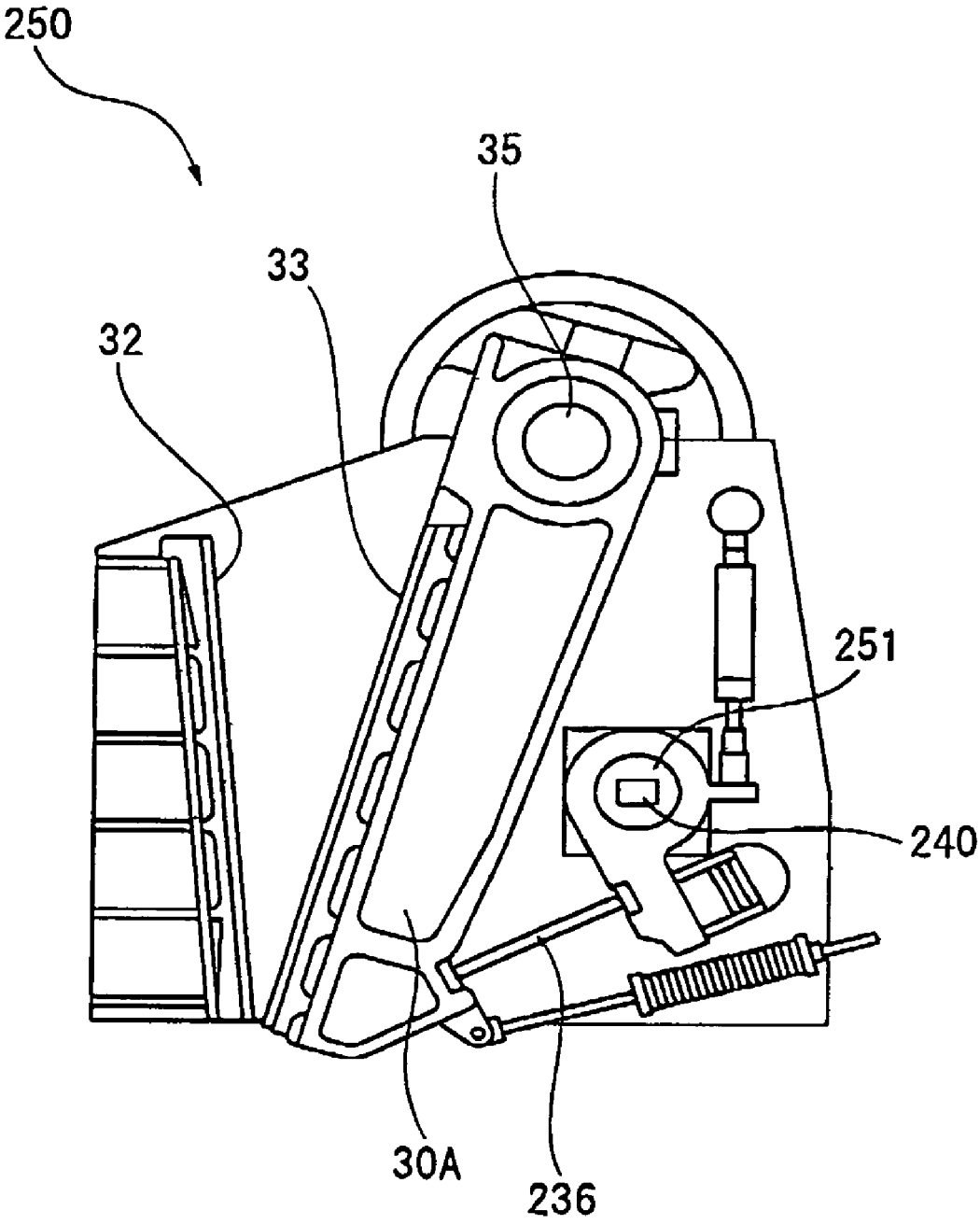
FIG. 17 is a lateral view showing a structure of a crusher that forms a self-traveling crushing machine according to a third embodiment of the invention.

In contrast, as shown in FIG. 17, the crusher 250 of the third embodiment is provided with the stress gauge 240 not on the toggle plate 236 but on a toggle pin 251 which forms the reaction-force supporting mechanism that supports force applied to the movable jaw 33 via the toggle plate 236. Based on detection signals detected by the stress gauge 240, the escape-operation determining section of the controller determines whether or not the escape operation is performed.

In this case, the movable jaw 33 may be overloaded in advance so that the toggle plate is intentionally buckled, where the stress applied to the toggle pin 251 upon the buckling may be measured to set the stress for determining escape operation based on the measured stress.

Figure 18:
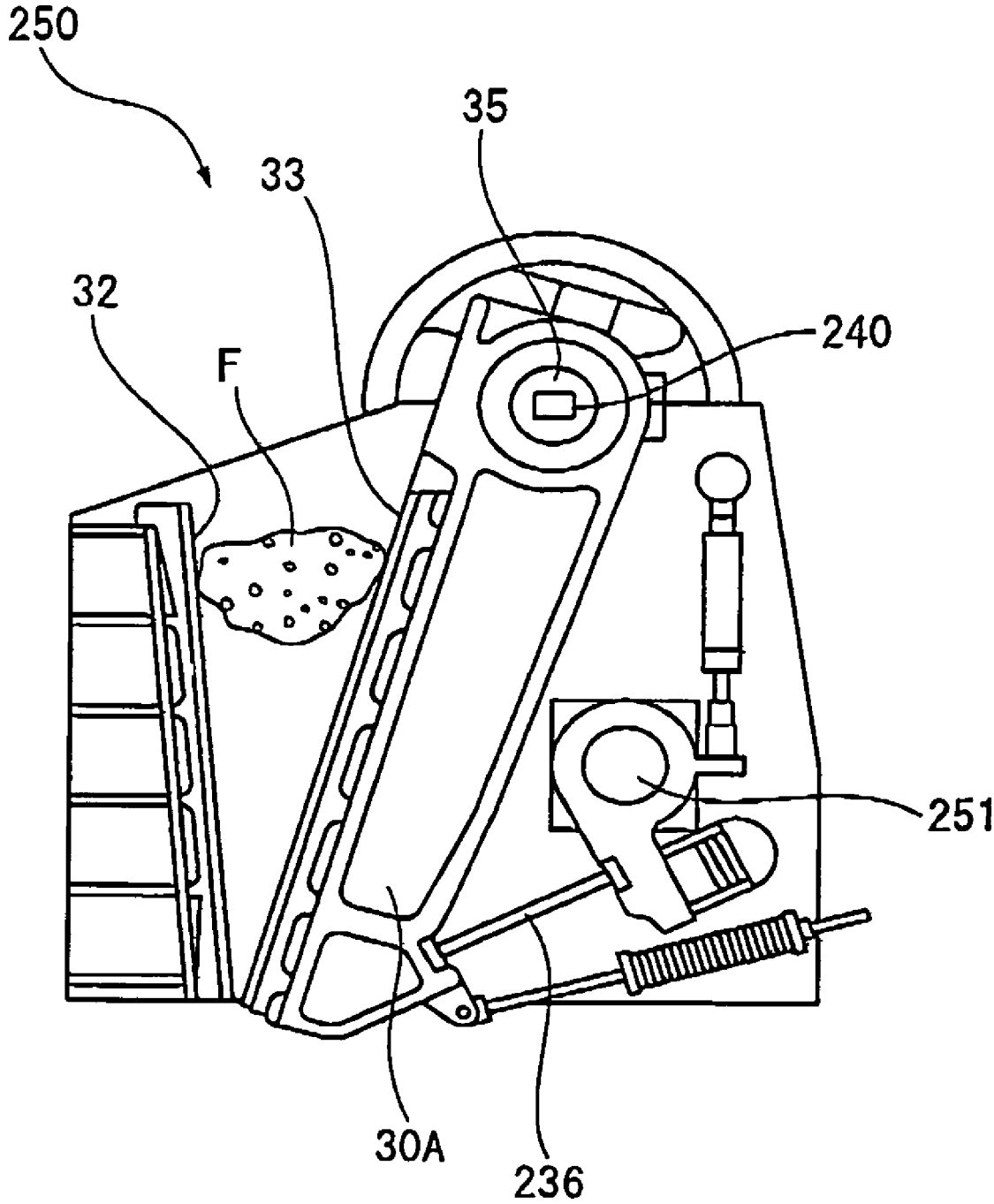
FIG. 18 is a lateral view showing a transformation of the crusher of the embodiment.

Such a method in which the stress gauge 240 is provided to the reaction-force supporting mechanism may be implemented by, for example, providing the stress gauge 240 on the eccentric drive shaft 35 as shown in FIG. 18.

Even if a large rock F and the like are thrown in the crusher 250 to overload an upper stream of the crusher 250, the stress gauge 240 provided to the eccentric drive shaft 35 can reliably detect the overload.

Modifications of Embodiments

Note that the scope of the invention is not limited to the embodiments set forth above, but includes modifications such as the following.

Though a jaw crusher is employed as the crusher 30 in the first embodiment, the scope of the invention is not limited thereto, but the invention may be implemented on an impact crusher and the like as long as a device for escaping overload is provided.

Specific structures, shapes, and the like for implementation of the invention may be suitably modified as long as an object of the invention can be achieved.

The invention claimed is:

1. A self-traveling crushing machine comprising:

a traveling device;

a crushing device that is provided on the traveling device and crushes a to-be-crushed object supplied thereto;

an overload escaping section that escapes an overload of the crushing device; and a controller that controls the crushing device, wherein the crushing device comprises a jaw crusher in which the to-be-crushed object is supplied to a V-shaped space formed by a fixed jaw and a movable jaw, and wherein the movable jaw swings relative to the fixed jaw to crush the to-be-crushed object, and wherein the controller comprises:

an escape-operation determining section that determines whether or not the overload escaping section has operated; and an information output section that sends escape operation information to an outside when the escape-operation determining section determines that escape operation has been conducted, wherein the overload escaping section comprises a toggle plate, the toggle plate having a first end connected to a crushing device body on which the fixed jaw is fixed and a second end connected to the movable jaw, the toggle plate buckling when the movable jaw is overloaded, and wherein the escape-operation determining section conducts determination of the escape operation based on a detection signal from a stress sensor that detects a change of a stress generated in the toggle plate.

2. The self-traveling crushing machine according to claim 1, wherein the escape-operation determining section determines a presence of the escape operation when the stress sensor detects a detection stress greater than a threshold stress that is set in advance to be smaller than a rupture stress of the toggle plate.

3. A self-traveling crushing machine comprising:

a traveling device;

a crushing device that is provided on the traveling device and crushes a to-be-crushed object supplied thereto;

an overload escaping section that escapes an overload of the crushing device; and a controller that controls the crushing device, wherein the crushing device comprises a jaw crusher in which the to-be-crushed object is supplied to a V-shaped space formed by a fixed jaw and a movable jaw, and wherein the movable jaw swings relative to the fixed jaw to crush the to-be-crushed object, wherein the controller comprises:

an escape-operation determining section that determines whether or not the overload escaping section has operated; and an information output section that sends escape operation information to an outside when the escape-operation determining section determines that escape operation has been conducted, wherein the overload escaping section comprises a toggle plate, the toggle plate having a first end connected to a crushing device body on which the fixed jaw is fixed and a second end connected to the movable jaw, the toggle plate buckling when the movable jaw is overloaded, wherein the toggle plate is connected to a reaction-force supporting mechanism, the reaction-force supporting mechanism being provided to the crushing device body and supporting a force applied to the movable jaw, and wherein the escape-operation determining section conducts determination of the escape operation based on a detection signal from a stress sensor that detects change of a stress applied to the reaction-force supporting mechanism.

4. An administrative system of a self-traveling crushing machine, the administrative system comprising:

at least one self-traveling crushing machine that comprises a traveling device, a crushing device that is provided on the traveling device and crushes a to-be-crushed object supplied thereto, an overload escaping section that escapes an overload of the crushing device, and a controller that controls the crushing device; and a server communicatively coupled to the self-traveling crushing machine, wherein:

the crushing device comprises a jaw crusher in which the to-be-crushed object is supplied to a V-shaped space formed by a fixed jaw and a movable jaw, and the movable jaw swings relative to the fixed jaw to crush the to-be-crushed object, the controller comprises:

an escape-operation determining section that determines whether or not the overload escaping section has operated; and an information output section that sends escape operation information to an outside when the escape-operation determining section determines that escape operation has been conducted, the overload escaping section comprises a toggle plate, the toggle plate having a first end connected to a crushing device body on which the fixed jaw is fixed and a second end connected to the movable jaw, the toggle plate buckling when the movable jaw is overloaded, the escape-operation determining section conducts determination of the escape operation based on a detection signal from a stress sensor that detects a change of a stress generated in the toggle plate, and the server comprises:

an information receiving section that receives the escape operation information sent from the information output section; and an escape-operation information accumulating section that accumulates the escape operation information received by the information receiving section in association with the self-traveling crushing machine from which the escape operation information is sent.

5. The administrative system of the self-traveling crushing machine according to claim 4, wherein the server further comprises:

an escape-operation count determining section that determines whether or not a count of the escape operation information accumulated in the escape-operation information accumulating section is not less than a predetermined threshold; and a notifier that notifies that the count is not less than the threshold when the escape-operation count determining section determines that the count is not less than the threshold.

6. The administrative system of the self-traveling crushing machine according to claim 5, wherein:

the notifier comprises an alarm-information sending section that sends alarm information to a notification target selected from the at least one self-traveling crushing machine, and the controller of the self-traveling crushing machine comprises an alarm calling section that calls an alarm when the alarm information is received.

* * * * *